US008018414B2

(12) United States Patent
Huang

(10) Patent No.: US 8,018,414 B2
(45) Date of Patent: Sep. 13, 2011

(54) ACTIVE MATRIX ORGANIC LIGHT EMITTING DIODE PIXEL UNIT

(75) Inventor: Jiunn-Yau Huang, Tainan County (TW)

(73) Assignee: Himax Technologies Ltd., Tainan County (TW)

( * ) Notice: Subject to any disclaimer, the term of this patent is extended or adjusted under 35 U.S.C. 154(b) by 879 days.

(21) Appl. No.: 11/797,738

(22) Filed: May 7, 2007

(65) Prior Publication Data

US 2007/0262939 A1 Nov. 15, 2007

(30) Foreign Application Priority Data

May 8, 2006 (TW) ..... 95116267 A

(51) Int. Cl.
*G09G 3/36* (2006.01)

(52) U.S. Cl. ..... 345/92; 345/82

(58) Field of Classification Search ..... 345/76, 345/82, 92, 204; 315/169.3, 169.1
See application file for complete search history.

(56) References Cited

U.S. PATENT DOCUMENTS

| | | | | |
|---|---|---|---|---|
| 6,858,991 | B2 * | 2/2005 | Miyazawa | 315/169.3 |
| 7,262,750 | B2 | 8/2007 | Sun | |
| 7,580,012 | B2 * | 8/2009 | Kim et al. | 315/169.3 |
| 2005/0179399 | A1 * | 8/2005 | Leo et al. | 315/169.3 |

FOREIGN PATENT DOCUMENTS

TW 200614111 5/2006

* cited by examiner

*Primary Examiner* — Quan-Zhen Wang
*Assistant Examiner* — Calvin Ma
(74) *Attorney, Agent, or Firm* — Rabin & Berdo, P.C.

(57) ABSTRACT

An active matrix OLED pixel unit disclosed includes four transistors, a capacitor and an OLED. Two transistors are used as switches for receiving two scan signals and a data signal is sent to the OLED via a current mirror structure formed by another two transistors in order to control the OLED luminance.

12 Claims, 3 Drawing Sheets

ACTIVE MATRIX ORGANIC LIGHT EMITTING DIODE PIXEL UNIT

This application claims the benefit of Taiwan application Serial No. 095116267, filed May 8, 2006, the subject matter of which is incorporated herein by reference.

BACKGROUND OF THE INVENTION

1. Field of the Invention

The invention relates in general to an active matrix organic light emitting diode (OLED) pixel unit, and more particularly to an active matrix OLED pixel unit applied in a liquid crystal display.

2. Description of the Related Art

FIG. 1 is a circuit diagram of a conventional active matrix OLED pixel unit. Referring to FIG. 1, the pixel unit includes a first switch 104, a second switch 106, a first transistor 105, a second transistor 108, a capacitor 107 and an OLED 109.

The first switch 104 has its control end for receiving a first scan signal SC1, its first end for receiving a data signal DT1 and its second end coupled to a second end of a first transistor 105. The first transistor 105 has its first end coupled to a positive voltage, its control end coupled to its second end and a first end of the second switch 106. The second switch 106 has its control end for receiving a second scan signal SC2 and its second end coupled to a control end of the second transistor 108. The second transistor has its first end coupled to the positive voltage and its second end coupled to an anode of the OLED 109. The cathode of the OLED 109 is coupled to a ground. The capacitor 107 is coupled between the positive voltage and the control end of the second transistor 108.

When the first scan signal SC1 and the second scan signal SC2 are enabled, the switches 104 and 106 are turned on to charge the capacitor 107 and a current corresponding to the data signal DT1 flows through the transistor 105. When the switch 106 is turned on, the transistors 105 and 108 form a current mirror structure such that the current corresponding to the data signal DT1 flows through the transistor 108 to generate a corresponding luminance of the OLED. When the first scan signal SC1 and the second scan signal SC2 are disabled, the switches 104 and 106 are turned off. The voltage drop across the capacitor 107 is unchanged, the transistor 108 remains to have the same current and thus the OLED 109 is still turned on.

According to the above design, the conventional structure of active matrix OLED pixel unit is still lack of design variety in manufacturing process when the extra wiring layout is needed to achieve a better electrical property.

SUMMARY OF THE INVENTION

The invention is directed to an active matrix OLED pixel unit using four transistors and a capacitor to achieve the purpose of controlling the OLED.

According to the present invention, an active matrix OLED pixel unit is provided. The active matrix OLED pixel unit comprises a first switch, a second switch, a first transistor, a second transistor and an energy storage device. The first switch has its first end for receiving a data signal, its control end for receiving a first scan signal, and its second end coupled to a first node. The second switch has its first end coupled to the first node, its second end coupled to a second node, and its control end for receiving a second scan signal. The first transistor has its first end coupled to the first node, its control end coupled to the first node, and its second end coupled to a fourth node. The second transistor has its first end coupled to a third node, its second end coupled to the fourth node, and its control end coupled to the second node. The OLED is coupled between the third node and a fifth node, wherein the fifth node is coupled to a positive voltage or a ground. The energy storage device is coupled between the second node and the fifth node.

The invention will become apparent from the following detailed description of the preferred but non-limiting embodiments. The following description is made with reference to the accompanying drawings.

DETAILED DESCRIPTION OF THE INVENTION

The active matrix OLED pixel unit according to the embodiment of the invention includes four transistors and a capacitor to achieve the purpose of controlling the OLED. Two transistors of them are switches for receiving a scan signal and another two transistors of them form a current mirror structure to send a current of data signal to the OLED. In the following description, the pixel units formed by N-type metal oxide semiconductor (NMOS) transistors and P-type metal oxide semiconductor (PMOS) transistors are illustrated by an embodiment respectively.

Figure 1:
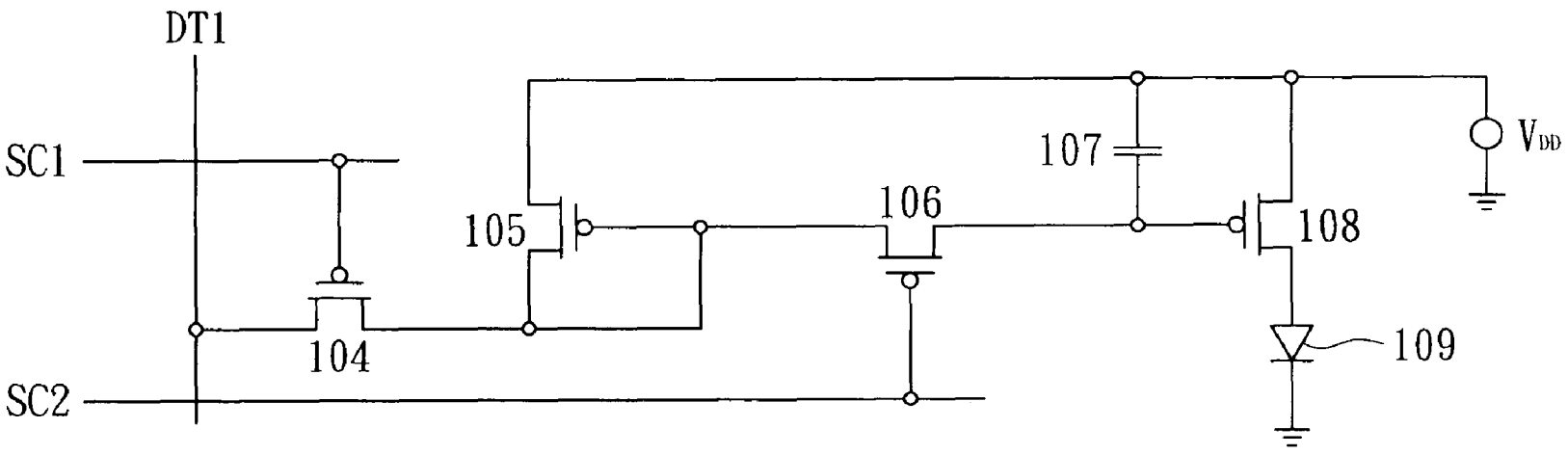
FIG. 1(PRIOR ART)
FIG. 1 is a circuit diagram of a conventional active matrix OLED pixel unit.
Figure 2:
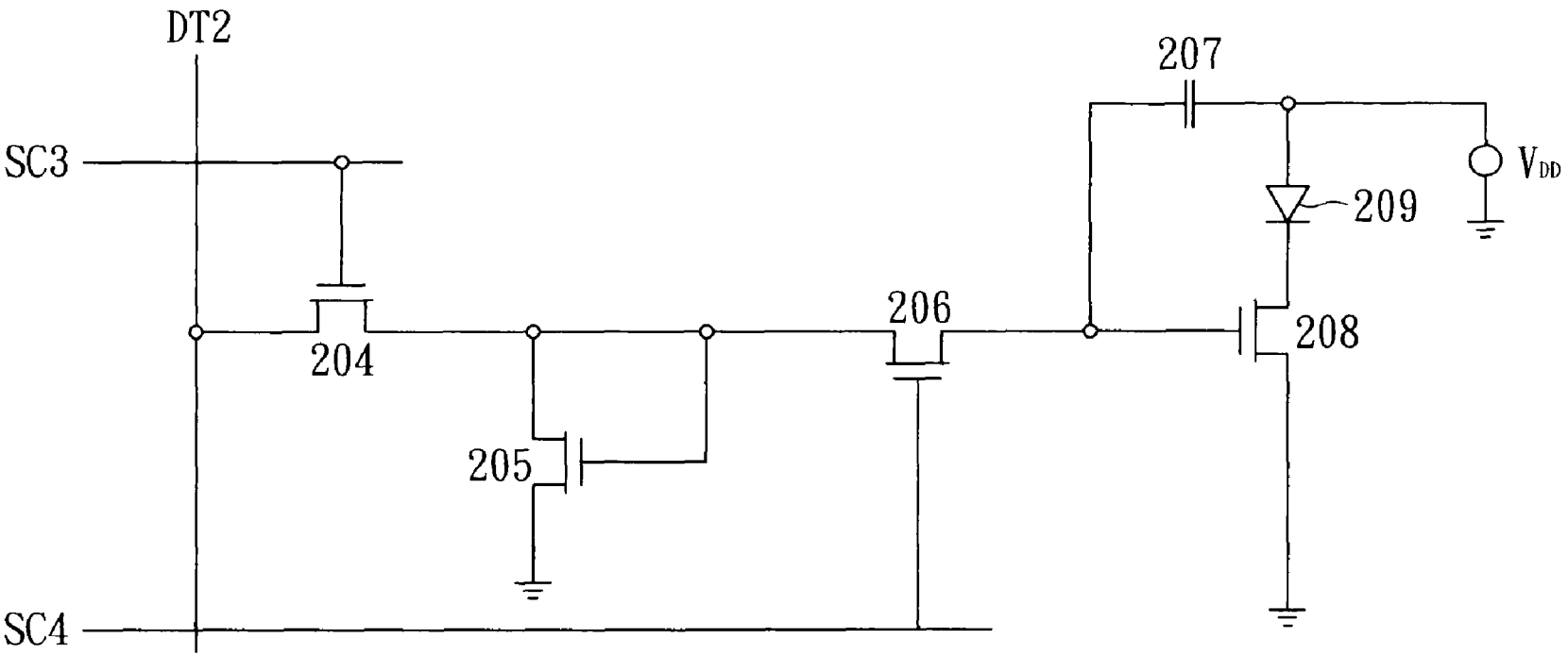
FIG. 2 is a circuit diagram of a conventional active matrix OLED pixel unit according to a preferred embodiment of the invention.

Referring to FIG. 2, a circuit diagram of a active matrix OLED pixel unit according to a preferred embodiment of the invention is shown. The active matrix OLED pixel unit includes a first switch 204, a second switch 206, a first transistor 205, a second transistor 208, a capacitor 207 and an OLED 209. The first switch 204, the second switch 206, the first transistor 205 and the second transistor 208 are all implemented by NMOS.

The first switch 204 has a control end for receiving a first scan signal SC3, a first end for receiving a data signal DT2, and a second end coupled to a first end of the first transistor 205. The first transistor 205 has a second end coupled to a ground, and a control end coupled to a first end of the second switch 206 and a first end of the first transistor 205. The second switch 206 has a control end for receiving a second scan signal SC4, and a second end coupled to a control end of the second transistor 208. The second transistor 208 has a first end coupled to a cathode of the OLED 209 and a second end coupled to the ground. The anode of the OLED 209 is coupled to a positive voltage. The capacitor 207 is coupled between the positive voltage and the control end of the second transistor 208.

When the first scan signal SC3 and the second scan signal SC4 are enabled, the switches 204 and 206 are turned on to charge the capacitor 207 and a current corresponding to the data signal DT2 flows through the transistor 205. When the switch 206 is turned on, the transistors 205 and 208 form a current mirror structure such that the current corresponding to the data signal DT2 flows through the transistor 208 to generate a corresponding luminance of the OLED. When the first scan signal SC3 and the second scan signal SC4 are disabled, the switches 204 and 206 are turned off. Since the voltage drop across the capacitor 207 is unchanged, the transistor 208 remains to have the same current, and thus the OLED 209 is still turned on.

Figure 3:
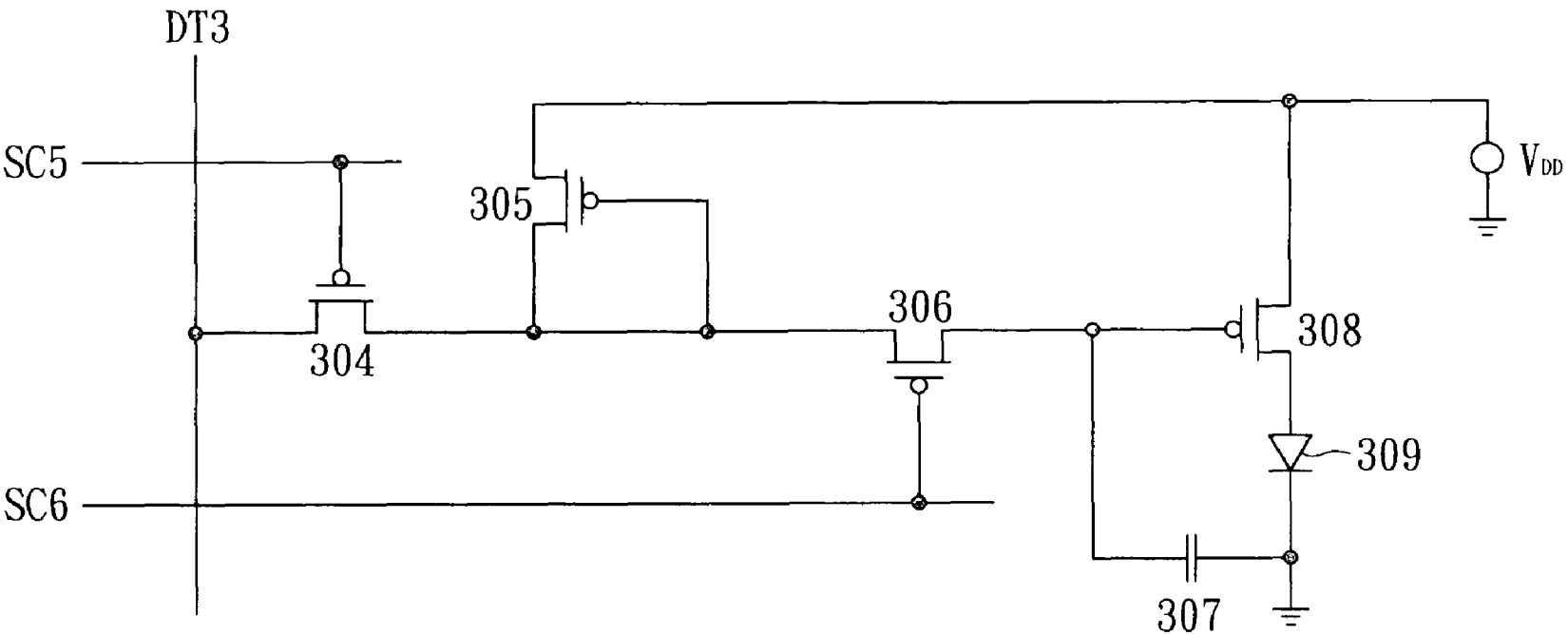
FIG. 3 is a circuit diagram of another active matrix OLED pixel unit according to a preferred embodiment of the invention.

Referring to FIG. 3, a circuit diagram of another active matrix OLED pixel unit according to a preferred embodiment of the invention is shown. The active matrix OLED pixel unit includes a first switch 304, a second switch 306, a first transistor 305, a second transistor 308, a capacitor 307 and an OLED 309. The first switch 304, the second switch 306, the first transistor 305 and the second transistor 308 are all implemented by PMOS.

The first switch 304 has its control end for receiving a first scan signal SC5, its first end for receiving a data signal DT3, and its second end coupled to a first end of the first transistor 305. The first transistor 305 has its second end coupled to a positive voltage and its first end, and its control end coupled to a first end of the second switch 306. The second switch 306 has its control end for receiving a second scan signal SC6, and its second end coupled to a control end of the second transistor 308. The second transistor 308 has its first end coupled to the positive voltage and its second end coupled to an anode of the OLED 309. The cathode of the OLED 309 is coupled to a ground. The capacitor 307 is coupled between the control end of the second transistor 308 and the ground.

When the first scan signal SC5 and the second scan signal SC6 are enabled, the switches 304 and 306 are turned on to charge the capacitor 307 and a current corresponding to the data signal DT3 flows through the transistor 305. When the switch 306 is turned on, the transistors 305 and 308 form a current mirror structure such that the current corresponding to the data signal DT3 flows through the transistor 308 to generate a corresponding luminance of the OLED. When the first scan signal SC5 and the second scan signal SC6 are disabled, the switches 304 and 306 are turned off. Since the voltage drop across the capacitor 307 is unchanged, the transistor 308 remains to have the same current, and thus the OLED 309 is still turned on.

The active matrix OLED pixel unit disclosed by the above embodiment of the invention uses two transistor switches for receiving two scan signals and sends a data signal to the OLED via a current mirror structure formed by another two transistors for controlling the OLED luminance.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An active matrix organic light emitting diode (OLED) pixel unit, comprising:

a first switch, having its first end receiving a data signal, its second end coupled to a first node and its control end receiving a first scan signal;

a second switch, having its first end coupled to the first node, a second end coupled to a second node and a control end receiving a second scan signal;

a first transistor, having its first end coupled to the first node, a second end directly connected to a fourth node and a control end coupled to the first node;

a second transistor, having its first end coupled to a third node, a second end directly connected to the fourth node and a control end coupled to the second node;

an OLED, connected between the third node and a fifth node coupled to a positive voltage or a ground; and an energy storage device, coupled between the second node and the fifth node, wherein the OLED is coupled between the second transistor and the energy storage device.

2. The active matrix OLED pixel unit according to claim 1, wherein the first switch, the second switch, the first transistor and the second transistor are implemented by a N-type metal oxide semiconductor (NMOS).

3. The active matrix OLED pixel unit according to claim 2, wherein the OLED has an anode coupled to the fifth node and a cathode coupled to the third node, the fourth node is coupled to the ground and the fifth node is coupled to the positive voltage.

4. The active matrix OLED pixel unit according to claim 3, wherein when the first scan signal and the second scan signal are enabled, the first switch and the second switch are turned on to charge the energy storage device and generate a voltage drop across the energy storage device, and accordingly the first transistor and the second transistor are turned on to respectively generate a current corresponding to the data signal such that the OLED can have a luminance corresponding to the data signal.

5. The active matrix OLED pixel unit according to claim 1, wherein the first switch, the second switch, the first transistor, and the second transistor are implemented by P-type metal oxide semiconductor (PMOS).

6. The active matrix OLED pixel unit according to claim 5, wherein the OLED has an anode coupled to the third node and a cathode coupled to the fifth node, the fourth node is coupled to the positive voltage, and the fifth node is coupled to the ground.

7. The active matrix OLED pixel unit according to claim 6, wherein when the first scan signal and second scan signal are enabled, the first switch and the second switch are turned on to charge the energy storage device and generate a voltage drop across the energy storage device and accordingly the first transistor and the second transistor are turned on to respectively generate a current corresponding to the data signal such that the OLED has a luminance corresponding to the data signal.

8. The active matrix OLED pixel unit according to claim 1, wherein the energy storage device is a capacitor.

9. The active matrix OLED pixel unit according to claim 1, wherein the control end of the first transistor is connected to the second end of the first switch and the first end of the second switch.

10. The active matrix OLED pixel unit according to claim 1, wherein the first and second switches serially connect the data signal to the control end of the second transistor.

11. The active matrix OLED pixel unit according to claim 10, wherein the fourth node is connected to ground or the positive voltage, independently of whether a data signal is applied to the first end of the first switch, whether a first scan signal is applied to the control end of the first switch and whether the second scan signal is applied to the control end of the second switch.

12. The active matrix OLED pixel unit according to claim 1, wherein the fourth node is connected to ground or the positive voltage, independently of whether a data signal is applied to the first end of the first switch, whether a first scan signal is applied to the control end of the first switch and whether the second scan signal is applied to the control end of the second switch.

* * * * *